US007048828B2

(12) United States Patent
Wiedow et al.

(10) Patent No.: US 7,048,828 B2
(45) Date of Patent: May 23, 2006

(54) CRIMPER WITH CRIMPING WHEELS MOUNTED ON LINEAR BEARINGS

(75) Inventors: Keith G. Wiedow, De Pere, WI (US); Lawrence J. Fuchs, Denmark, WI (US)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/723,282

(22) Filed: Nov. 26, 2003

(65) Prior Publication Data

US 2005/0109477 A1 May 26, 2005

(51) Int. Cl.
*B31F 1/12* (2006.01)
*D21G 1/12* (2006.01)

(52) U.S. Cl. ..... 162/280; 162/281; 162/111; 428/152; 428/191; 425/369; 425/391; 19/66.1

(58) Field of Classification Search ..... 162/280, 162/281, 111; 428/152, 153, 191; 19/66.1; 57/31; 425/369, 391
See application file for complete search history.

(56) References Cited

U.S. PATENT DOCUMENTS

| | | | |
|---|---|---|---|
| 1,774,497 | A | 8/1930 | Wandel |
| 1,954,965 | A | 4/1934 | Thode |
| 2,591,359 | A | 4/1952 | Joa |
| 3,074,324 | A | 1/1963 | Nobbe |
| 3,377,224 | A | 4/1968 | Gresham et al. |
| 3,792,820 | A | 2/1974 | Lucas |
| 3,834,286 | A | 9/1974 | Nystrand |
| 4,144,124 | A | 3/1979 | Turunen et al. |
| 4,376,671 | A | 3/1983 | Schulz |
| 4,516,454 | A | 5/1985 | Mosburger |
| 4,548,105 | A | 10/1985 | Koutonen |
| 4,621,785 | A | 11/1986 | Embra |
| 4,941,826 | A | 7/1990 | Loran et al. |
| 5,543,202 | A | 8/1996 | Clark et al. |
| 5,622,734 | A | 4/1997 | Clark et al. |
| 5,698,291 | A | 12/1997 | Clark et al. |
| 5,736,223 | A | 4/1998 | Laurent |
| 5,961,899 | A | 10/1999 | Rossetti et al. |
| 6,021,790 | A | 2/2000 | Yoshitani et al. |
| 6,156,158 | A | 12/2000 | Kustermann |
| 6,488,226 | B1 | 12/2002 | McNeil et al. |
| 6,501,500 | B1 | 12/2002 | Olenio et al. |
| 6,578,617 | B1 | 6/2003 | Biagiotti |
| 6,621,694 | B1 | 9/2003 | Lee et al. |
| 2002/0092633 | A1 | 7/2002 | Odhe et al. |
| 2003/0075262 | A1 | 4/2003 | Hein et al. |

*Primary Examiner*—Mark Halpern
(74) *Attorney, Agent, or Firm*—Stiennon & Stiennon

(57) ABSTRACT

A tissue paper crimper of greater rigidity is provided by mounting crimper disks to linear bearings which in turn are mounted to a carriage which can be positioned in the cross machine direction on a frame. The crimper disks are pressed against anvil roll pneumatic actuators. The use of linear bearings allows the crimper to run at higher operating speeds. An air knife is positioned so that a jet of air following a Coanda surface periodically blows against the rotating crimping wheel and thereby removes fibers before they build up. Buildup of fibers on the crimping wheels from the tissue webs being crimped can cause the wheels to become unbalanced, resulting in undesirable vibration. The rigid mounting and the prevention of fiber buildup will allow the crimper of this invention to operate at higher machine speeds.

10 Claims, 3 Drawing Sheets

CRIMPER WITH CRIMPING WHEELS MOUNTED ON LINEAR BEARINGS

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to crimping devices on paper converting and paper winding machines.

Most tissue paper products such as facial tissue are constructed from two or more tissue paper layers or webs. Multi-ply tissue is made by bringing two or more tissue webs together and forming a single web by joining the individual webs by crimping. The crimping is effected by a plurality of crimping wheels or disks which are spaced, for example, eight to twelve inches apart in the cross machine direction. The crimping wheels or disks run against and are driven by an anvil roll. The peripheral edge of the crimping wheel has a pattern which forms a crimping pattern on the multi-ply tissue which joins together the individual tissue webs when the individual webs pass between a nip formed between the crimping wheel periphery and the anvil roll. The multi-ply tissue web is then slit to form narrower rolls which may be, for example, 16 to 24 inches wide. Facial tissue or the like is then formed from these narrower crimped and split rolls. The crimping wheels are typically mounted on a pivoting mechanism which brings the crimping wheels into engagement with the anvil roll. The pivot mechanism allows simple and rapid opening of the gap between the crimping wheels and the anvil roll which facilitates threading of the tissue webs.

Over time the speed of paper handling equipment has increased in order to reduce production costs. However, existing tissue crimping equipment is not sufficiently rigid to allow operation at higher operating speeds, particularly speeds in excess of 4000 to even 6000 ft. per minute. What is needed is a tissue crimping machine which can operate at higher speeds.

SUMMARY OF THE INVENTION

The crimper of this invention has groups of two crimping wheels mounted to a transverse or cross machine direction carriage which can be moved and positioned in the cross machine direction. The transverse carriage is mounted for cross machine direction movement by four rollers which ride on a cross machine direction round bar. In addition a vertical flat bar held is between four rollers mounted to the transverse carriage. A spring-loaded clamp on the transverse carriage grabs the vertical bar to prevent cross machine direction motion of the transverse carriage. The transverse carriage may be moved by pneumatically actuating a rubber air-bladder which unclamps the flat bar, allowing the carriage to be moved on the two rollers in the cross machine direction.

Each crimping wheel is mounted to the transverse carriage by a support arm which in turn is mounted to a vertical carriage mounted for sliding motion on a linear bearing formed by vertical ways. A spring return air cylinder is mounted between each support bracket and the transverse carriage and is operable to move each vertical carriage and crimping wheel mounted thereto in the vertical direction. Downward vertical motion of each vertical carriage causes each crimping wheel to engage an anvil roll which extends in a cross machine direction. The mounting of the crimping wheels to the vertical carriages which ride on ways produces a rigid mount which allows operation of the crimping wheels at higher speeds. An air knife is mounted to the transverse carriage and positioned so that a jet of air is formed and blown along a coanda surface so the air jet is directed upwardly. The air jet is operated to periodically blow against the rotating crimping wheel and thereby remove fibers before they build up. Buildup of fibers on the crimping wheels from the tissue webs being crimped can cause the wheels to become unbalanced, resulting in undesirable vibration. The rigid mounting and the prevention of fiber buildup will allow the crimper of this invention to operate at machine speeds of up to 4,000 ft. per minute, even 6,000 ft. per minute or more.

It is a feature of the present invention to provide a crimping wheel which is mounted to and positioned on linear bearings.

It is a further feature of the present invention to provide a crimping wheel which incorporates a feature to prevent the build up of fibers on the crimping wheel.

It is another feature of the present invention to provide a crimping wheel which can be operated at higher speeds.

Further objects, features and advantages of the invention will be apparent from the following detailed description when taken in conjunction with the accompanying drawings.

DESCRIPTION OF THE PREFERRED EMBODIMENTS

Figure 1:
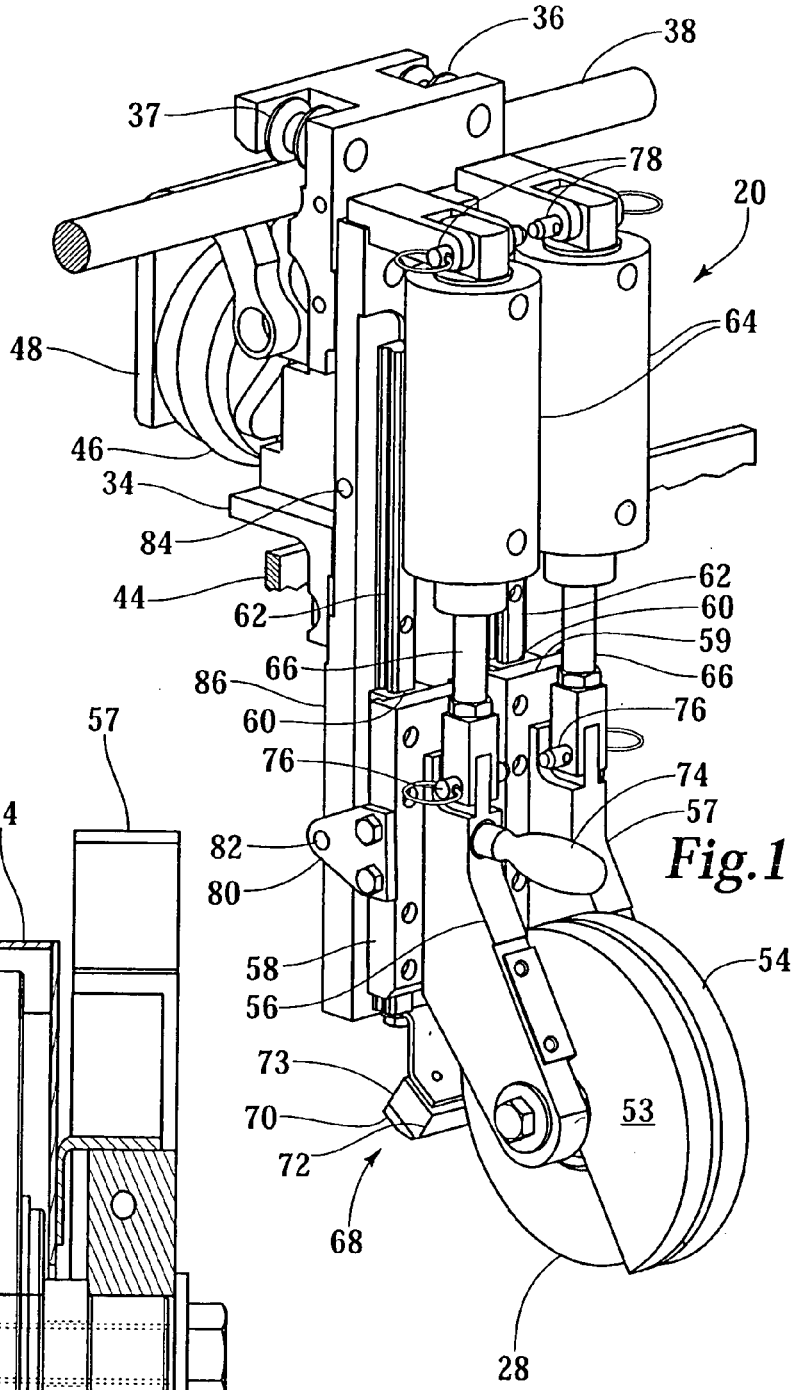
FIG. 1 is an front isometric view of the crimper of this invention.
Figure 2:
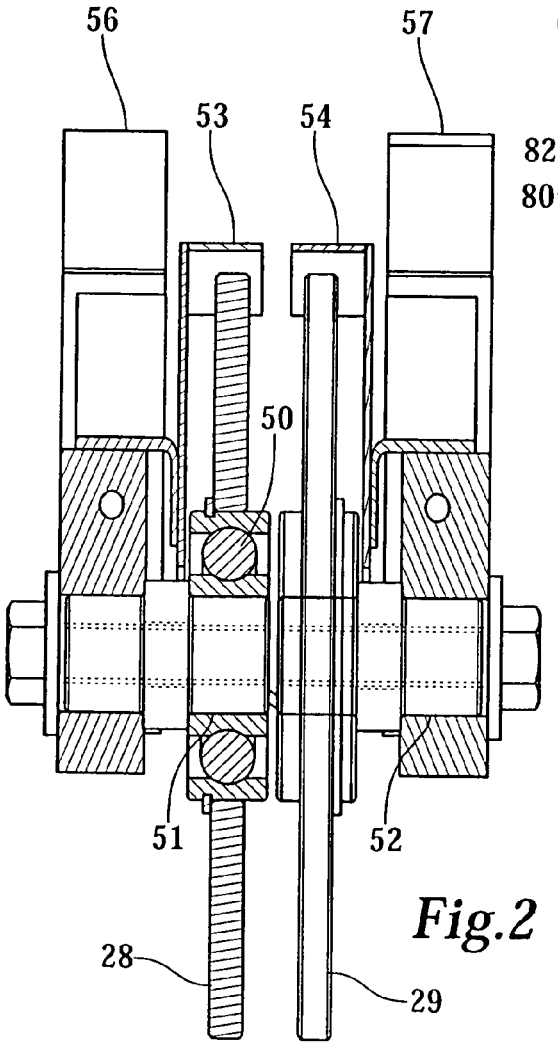
FIG. 2 is a partial cross-sectional view taken through the shaft which supports the crimping wheels of the crimper of the FIG. 1.
Figure 3:
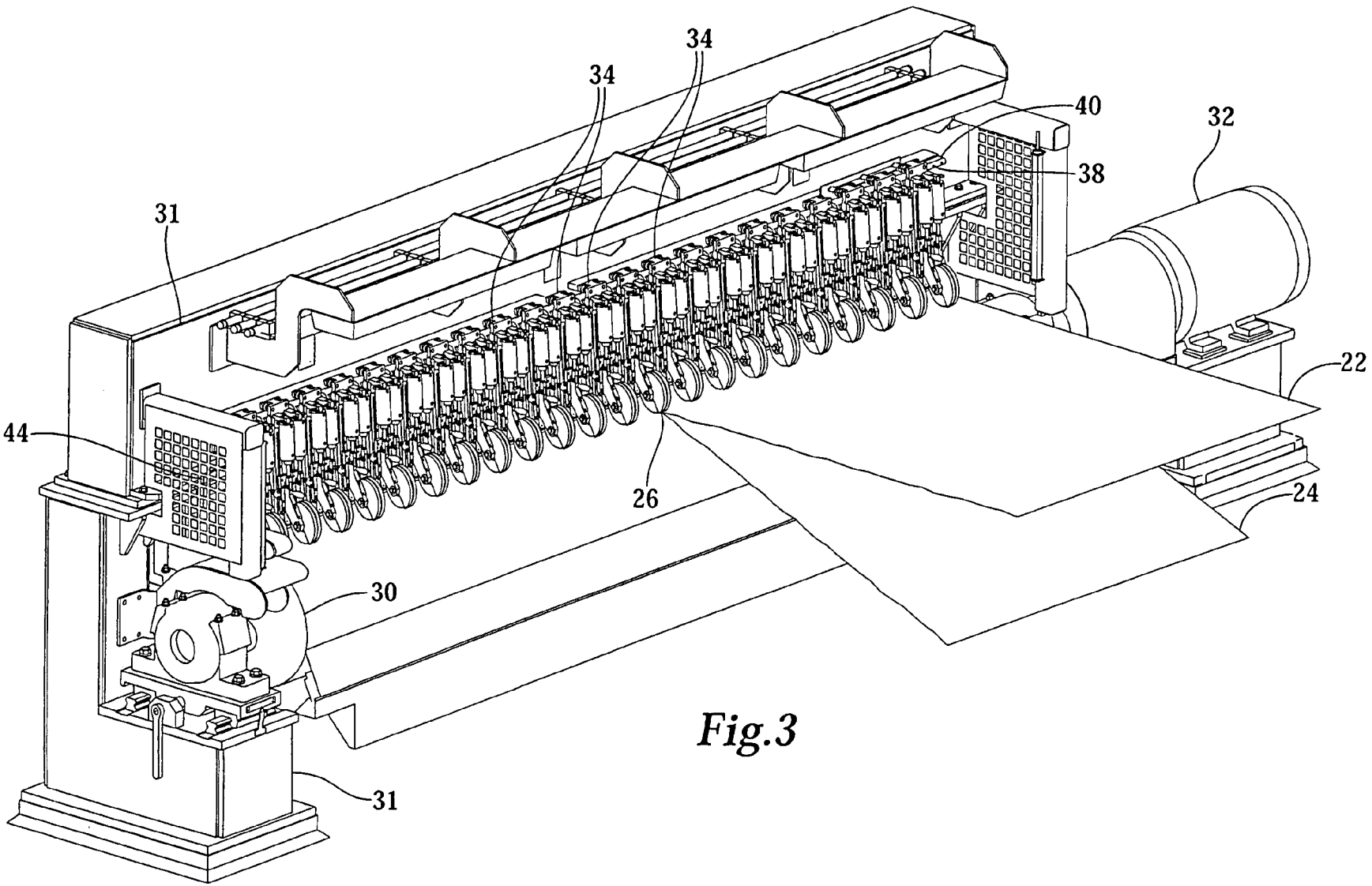
FIG. 3 is an isometric view of a plurality of crimpers of FIG. 1 positioned to engage multiple webs.

Referring more particularly to FIGS. 1–4, wherein like numbers refer to similar parts, a crimper 20 is shown in FIG. 1. A plurality of crimpers 20, as shown in FIG. 3, join together a first tissue web 22 to a second tissue web 24 by pressing the webs 22 and 24 together in a nips 26 formed between first and second crimping wheels 28, 29 and an anvil roll 30. The anvil roll 30 is mounted for rotation on a machine frame 31, extends in the cross machine direction, and is driven by a motor 32.

Figure 4:
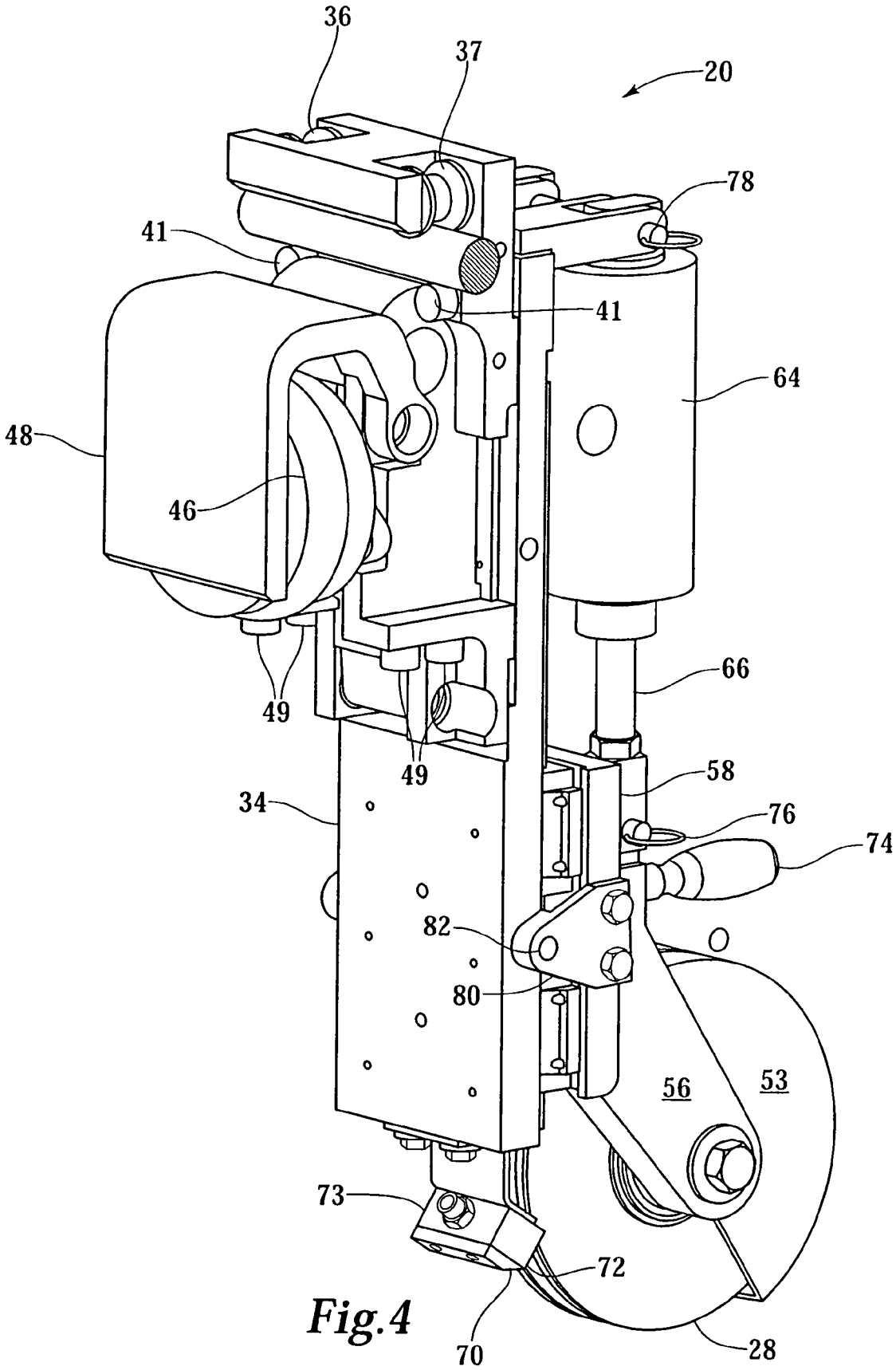
FIG. 4 is an rear isometric view of the crimper of FIG. 1

Each crimper 20, as shown in FIGS. 1 and 4, has a transverse carriage 34 which is mounted for motion in the cross machine direction. The transverse carriage 34 has a pair of spaced apart, grooved rollers 36, 37 which ride on a cross machine direction extending round rail 38 which fits within the groove in the rollers 36, 37. The round rail 38 is mounted by to machined V-groove in a flange 40 which is mounted to the crimping machine frame 31 as shown in FIG. 3. The rail 38 may be terminated in the cross machine direction by a washer (not shown) to prevent the crimpers 20 from sliding off the rail 38.

Mounted to the transverse carriage are also two rolls 41 positioned beneath the round rail 38 to prevent upward movement of the transverse carriage 34 in response to downward movement of the crimping wheels 28, 29 as shown in FIG. 4. A spring-loaded brake (not shown) on the transverse carriage 34 grips a vertical bar 44 which is also mounted to the machine frame 31 as shown in FIG. 3. A rubber air-bladder 46 shown in FIG. 1 is mounted to the transverse carriage 34 and can actuate a member 48 to release the brake. The vertical bar 44 is positioned between four vertical axis rollers 49 which are mounted to the transverse carriage 34 as shown in FIG. 4. The arrangement of the transverse carriage 34 and its means of positioning in the cross machine direction is similar to carriages used to position slitting blade carriages such as are known in the art.

The crimping wheels 28, 29 are mounted by bearings 50 to opposed stub shafts 51, 52 as shown in FIG. 2. The stub shafts 51, 52 extend through arms or brackets 56, 57 which are mounted to vertical carriages 58, 59. The brackets 56, 57 are preferably constructed of 6061-T6 aluminum for light weight and stiffness. The stub shafts 51 and 52 extend in opposite directions and towards each other, thereby positioning the crimping wheels 28, 29 in spaced parallel relation. The vertical carriages 58, 59 have interlocking grooves 60 which ride on vertical ways 62. The interlocking grooves 60 and the ways 62 provide a rigid mounting which allows vertical movement of the crimping wheels 28, 29 by pneumatic actuators 64. The pneumatic actuators 64 extend between the transverse carriage 34 and the vertical carriages 58, 59. The pneumatic actuators 64 have internal springs (not shown) which retract piston rods 66 when pressure is vented from the pneumatic actuators 64. The pneumatic actuators are supplied with compressed air and provide a downward stroke, for example of two inches, which brings the crimping wheels 28, 29 into engagement against the anvil roll 30 with a downward force of, for example, 450 lbs. The crimping wheels 28, 29 have corresponding guards 53, 54 to protect machine operators. The guards 53, 54 cover only one side of the crimping wheels and their peripheral edges allow access to the crimping wheels without removal of the guards.

An air knife 68 which has an air duct 70 located on the underside of Coanda surface 72 on a transverse bar 73 which extends in the cross machine direction in front of the crimping wheels 28, 29. The Coanda surface 72 directs a stream of air from the air duct 70 upwardly at about a forty-five degree angle against the rotating crimping wheels 28, 29. The air knife 68 can be used to periodically remove any buildup of web fibers on the crimping wheels. Such a buildup of fibers on the crimping wheels could result in undesirable vibration of the crimping wheels 28, 29.

The vertical carriage 58 has a handle 74 for moving the transverse carriage and positioning it in the cross machine direction. The handle can also be used to raise the vertical carriage 58 after the pneumatic actuator 64 immediately above the first crimping wheel 28 has been detached from the vertical carriage 58 by removing first pin 76 and pivoting the pneumatic actuator upwardly about a second pin 78, or after the pneumatic actuator 64 is completely removed by removing the first pin 76 and the second pin 78. A bracket 80 mounted to the side of the vertical carriage 58 has a pin hole 82 which can, when the vertical carriage is raised, be positioned over a matching positioning hole 84 in the side 86 of the transverse carriage 34 and retained in the raised position by inserting a pin through the pin hole 82 in the bracket 80 into the positioning hole 84. In this position it is possible to access both crimping wheels 28, 29 for replacement or maintenance.

It should be understood that the linear bearings which connect the vertical carriages to the transverse carriage could be of any type so long as they provide the necessary rigidity to allow the crimper to operate at speeds of up to 4,000 feet per minute or more.

It also be understood that the air knife 68 could be operated continuously but will preferably be operated only periodically to reduce the cost of compressed air.

It should also be understood that the number of crimping wheels mounted to a single transverse carriage could vary. It should also be understood the periphery edge of the crimping wheels 28, 29 will have a pattern formed thereon to produces a desired pattern of crimps, which can depending on the type and number of tissue webs being joined.

It is understood that the invention is not limited to the particular construction and arrangement of parts herein illustrated and described, but embraces all such modified forms thereof as come within the scope of the following claims.

We claim:

1. An apparatus for crimping together multiple layers of tissue paper web comprising:

a plurality of transverse carriages mounted for motion in a cross machine direction;

an anvil roll mounted for rotation and extending in the cross machine direction;

wherein each transverse carriage has a support bracket mounted thereto by a linear bearing and at least one crimping wheel mounted for rotation to the support bracket, the support bracket being mounted by the linear bearing for linear vertical movement on the transverse carriage toward and away from the anvil roll; and wherein each transverse carriage has at least one linear actuator extending between the transverse carriage and the support bracket, the linear actuator operable to cause linear movement on the linear bearing of the support bracket and the crimping wheel mounted thereto so that the crimping wheel mounted to the support bracket is movable into and out of engagement with the anvil roll.

2. The apparatus of claim 1 wherein the support bracket is mounted to a vertical carriage, and wherein the support bracket and the vertical carriage have portions which define a mating vertical groove and way to define the linear bearing.

3. The apparatus of claim 1 further comprising an air knife mounted to each transverse carriage and positioned to direct a stream of air against said at least one crimping wheel mounted for rotation to said each support bracket.

4. The apparatus of claim 3 wherein the air knife further comprises a member positioned above an air duct forming part of the air knife, the member having a Coanda surface arranged to direct air from the duct toward the at least one crimping wheel.

5. The apparatus of claim 1 further comprising:

a first crimping wheel mounted for rotation on a first support bracket, the first support bracket being mounted by a first linear bearing to the transverse carriage for vertical movement toward and away from the anvil roll;

wherein the at least one linear actuator comprises a first linear actuator extending between the transverse carriage and the first support bracket on the transverse carriage, the first linear actuator arranged to cause vertical movement of the first support bracket and the first crimping wheel mounted thereto into and out of engagement with the anvil roll;

a second crimping wheel mounted for rotation on a second support bracket, the second support bracket mounted by a second linear bearing to the transverse carriage for vertical movement toward and away from the anvil roll, the first and second crimping wheels being mounted in spaced parallel relation; and wherein the at least one linear actuator further comprises a second linear actuator extending between the transverse carriage and the second support bracket on the transverse carriage, the second linear actuator arranged to cause vertical movement of the second support bracket and the second crimping wheel mounted thereto into and out of engagement with the anvil roll.

6. The apparatus of claim 5 wherein the first linear actuator is arranged to be disconnected from between the transverse carriage and the first support bracket, and when disconnected the first crimping wheel and the first support bracket are arranged to be slid upwardly on the first linear bearing so as to provide access to the first crimping wheel and the second crimping wheel.

7. The apparatus of claim 6 further comprising a locking mechanism which has the function of locking the first support bracket and the first crimping wheel in a raised position to the transverse carriage, the raised position arranged to provide access to the first crimping wheel and the second crimping wheel.

8. The apparatus of claim 6 further comprising a handle mounted to the first support bracket, the handle arranged for positioning the transverse carriage, and arranged for raising and lowering the first crimping wheel.

9. The apparatus of claim 5 wherein the first crimping wheel is mounted to a stub shaft which extends in a first direction from the first support bracket, and the second crimping wheel is mounted to a second stub shaft which extends from the second support bracket in a direction opposite the first direction, so that the first stub shaft and the second stub shaft extend towards each other.

10. The apparatus of claim 9 further comprising:

a first guard mounted to the first bracket and extending radially outwardly from the first stub shaft and then extending axially to cover a portion of the first crimper peripheral edge; and a second guard mounted to the second bracket and extending radially outwardly from the second stub shaft and then extending axially to cover a portion of the second crimper peripheral edge.

* * * * *